US010094139B2

(12) United States Patent
Hotes et al.

(10) Patent No.: US 10,094,139 B2
(45) **Date of Patent: *Oct. 9, 2018**

(54) PORTABLE SHELTER WITH OUTER VINYL AND LOW EMISSIVITY LAYERS

(71) Applicant: Alaska Structures, Inc., Anchorage, AK (US)

(72) Inventors: Richard W. Hotes, Anchorage, AK (US); Michael Vesper, Adamstown, MD (US)

(73) Assignee: Alaska Structures, Inc., Anchorage, AK (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/155,645

(22) Filed: May 16, 2016

(65) Prior Publication Data

US 2016/0258180 A1 Sep. 8, 2016

Related U.S. Application Data

(63) Continuation of application No. 13/596,301, filed on Aug. 28, 2012, now Pat. No. 9,340,994.

(51) Int. Cl.

| | |
|---|---|
| ***E04H 15/10*** | (2006.01) |
| ***E04H 15/54*** | (2006.01) |
| ***E04B 1/74*** | (2006.01) |
| ***E04H 15/36*** | (2006.01) |
| ***E04H 15/18*** | (2006.01) |
| ***E04H 15/64*** | (2006.01) |
| *E04H 15/20* | (2006.01) |
| *E04B 1/76* | (2006.01) |

(52) U.S. Cl.

CPC ..... *E04H 15/10* (2013.01); *E04B 1/74* (2013.01); *E04H 15/18* (2013.01); *E04H 15/36* (2013.01); *E04H 15/54* (2013.01); *E04H 15/64* (2013.01); *E04B 2001/7691* (2013.01); *E04H 2015/201* (2013.01); *E04H 2015/203* (2013.01); *E04H 2015/207* (2013.01); *Y10T 29/49002* (2015.01)

(58) Field of Classification Search

CPC ..... E04H 15/54; E04H 15/36; E04H 15/10; E04H 2015/207; E04H 9/14; E04H 1/02; E04B 1/74; E04B 1/762; E04B 1/32; E04B 1/62; Y10T 29/49002

USPC ..... 135/87, 91–94, 96, 115, 119, 124, 137, 135/905–908; 52/63, 86, 169.11, 745.15, 52/471.3, 783.1

See application file for complete search history.

(56) References Cited

U.S. PATENT DOCUMENTS 2,948,362 A 8/1960 Jones
3,233,617 A * 2/1966 Stern ..... E04B 1/34326 135/138

(Continued)

FOREIGN PATENT DOCUMENTS

WO WO 00/24832 5/2000

*Primary Examiner* — Winnie Yip
(74) *Attorney, Agent, or Firm* — Blank Rome LLP

(57) ABSTRACT

A portable shelter with low emissivity is provided for sheltering materials or human occupants at a remote location. The shelter has a flexible, multi-layer cover, including a vinyl material, reflective material located inside and immediately adjacent to the vinyl material, and insulation material located inside the reflective material. The low-ε vinyl cover is lightweight and thermally efficient. The shelter may be adapted for use with interior-climate control equipment at the remote location.

14 Claims, 1 Drawing Sheet

(56) References Cited

U.S. PATENT DOCUMENTS

| | | | | |
|---|---|---|---|---|
| 4,024,679 | A | 5/1977 | Rain et al. | |
| 4,279,112 | A | 7/1981 | Bertrand | |
| 4,308,882 | A | 1/1982 | Pusch et al. | |
| 4,705,717 | A | 11/1987 | Cain et al. | |
| 4,869,037 | A * | 9/1989 | Murphy | E04B 1/642 52/238.1 |
| 5,547,734 | A | 8/1996 | Tusch | |
| 6,599,850 | B1 | 7/2003 | Heifetz | |
| 6,679,009 | B2 | 1/2004 | Hotes | |
| 7,128,207 | B2 | 10/2006 | Anderson et al. | |
| 7,735,502 | B1 | 6/2010 | Hotes | |
| 7,882,849 | B2 | 2/2011 | Franta | |
| 8,025,985 | B2 | 9/2011 | Nutz et al. | |
| 8,146,298 | B2 | 4/2012 | Bush et al. | |
| 8,534,305 | B1 | 9/2013 | Woodall et al. | |
| 8,997,767 | B2 * | 4/2015 | Hotes | E04H 9/16 135/115 |
| 9,371,665 | B2 * | 6/2016 | Herpin | E04H 15/40 |
| 2004/0013868 | A1 | 1/2004 | Dadalas et al. | |
| 2011/0130062 | A1 | 6/2011 | Squires | |
| 2011/0262699 | A1 | 10/2011 | Yializis et al. | |

* cited by examiner

PORTABLE SHELTER WITH OUTER VINYL AND LOW EMISSIVITY LAYERS

This application is a continuation of U.S. patent application Ser. No. 13/596,301, filed Aug. 28, 2012, the entire disclosure of which is incorporated herein by reference.

The present invention relates to portable shelters, including lightweight tents, configured for heating, ventilation and/or air conditioning (HVAC). The shelters may be adapted for use in hot, remote locations, including but not limited to deserts and jungles. The shelters may also be used in cold climates with a heated interior. The remote locations at which the shelters may be constructed and operated with HVAC may be, for example, a mile or more from any well-maintained road or airport.

Insulation systems that have been employed in prior art shelters are bulky, heavy and/or expensive. The present invention employs multi-layer fabric that is sufficiently lightweight to be easily transportable to a remote location, and sufficiently thermally-insulative to support efficient air conditioning (or other HVAC operations). The latter is especially important where the power source and/or fuel for the HVAC unit must itself be transported to the remote location.

The disadvantages of the prior art can be overcome to a great extent by the present invention, which may be in the form of a portable shelter that has a lightweight, rigid support structure and a cover made of flexible, multi-layer, thermally-insulative fabric. According to a preferred embodiment of the invention, at least one of the outermost layers of the fabric blocks radiant thermal energy from being absorbed into the shelter in hot exterior temperatures and/or blocks thermal energy from escaping the shelter in cold exterior temperatures.

According to a preferred embodiment, the flexible fabric does not rely solely on the density of an insulating material to decrease the mean free path by which photons can travel and radiate. Moreover, the fabric does not rely exclusively on eliminating convective air movement. That is, the fabric does not rely solely on the creation of air cells, pockets or tortuous pathways.

According to the present invention, heat energy can be prevented from entering or escaping the system by a radiation barrier located among the outermost layers of the fabric. Most or all radiant thermal energy that would otherwise enter the shelter through the fabric is prevented from being absorbed by and passing through the fabric. In addition, layers for reducing heat convection and conduction may be provided to inhibit the transfer of any thermal energy that is absorbed (not reflected) by the outermost layer or layers.

According to another aspect of the invention, an interior-facing portion of a vinyl layer is coated with a thin, metallized, protected surface. The vinyl layer may be the outermost layer of the multi-layer fabric. The resulting low emissivity (low $\varepsilon$) vinyl allows for only a reduced amount of incident thermal radiation to pass through. Consequently, less heat energy is transmitted through the initial (outermost) layers of the shelter. Less heat energy is transferred to the anti-conductive/convective insulating layers, thereby eliminating or reducing the need for bulky batting to achieve the same degree of thermal protection.

The invention may contribute to a lower air conditioning (or other HVAC) load for the shelter. The unique configuration of the improved shelter, with its low-emissivity (low $\varepsilon$) multi-layer fabric, can provide energy savings that are equal to or greater than bulkier, more-expensive systems.

The reduced weight and volume of the materials required for the total insulation package may enable a smaller and more convenient pack out for easier transportation, for example, by hand, by helicopter, or by air transport, and result in lower cost due to less use of material. For certain applications, if desired, the components of the shelter can be sufficiently lightweight to be easily stored and/or transported to a remote location.

DETAILED DESCRIPTION

Figure 1:
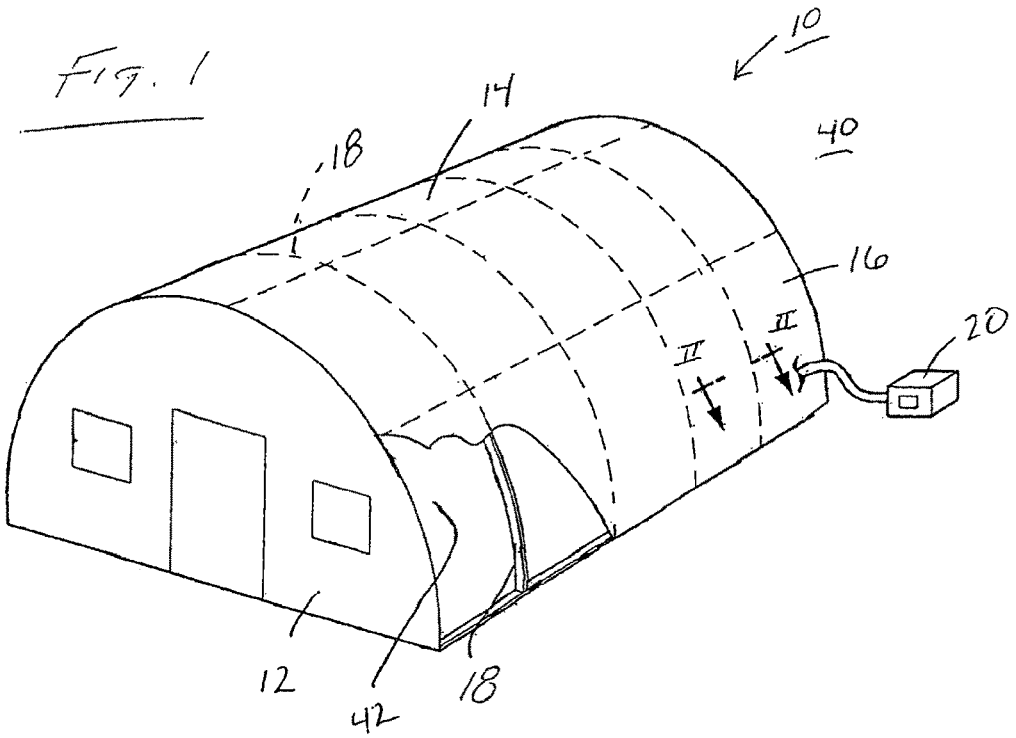
FIG. 1 is a partially broken-away, perspective view of a shelter constructed in accordance with a preferred embodiment, showing the cover and the covered frame.

Turning now to the drawings, where like reference numerals designate like elements, there is shown in FIG. 1 a portable shelter 10 that is constructed in accordance with a preferred embodiment of the present invention. The shelter 10 has a front wall 12, a back wall (not shown), a roof 14, and side walls 16. The left side wall (not shown) is the mirror image of the right side wall 16. The front and back walls 12, the roof 14, and the side walls 16 are supported by a suitable frame 18 made of lightweight aluminum (or steel) tubes, wooden poles, or the like. In an alternative embodiment, the frame for supporting the shelter may be formed by suitable inflated air beams, or by a suitable combination of air beams and metal or wood support devices. The present invention should not be limited to the exemplary configurations and structures described herein, except as provided for in the appended claims. Depending on expected wind and other conditions, the shelter 10 may be tied down by wires or ropes, stakes, or the like.

In operation, the frame 18 is constructed at the remote location, and then the front and back walls 12, the roof 14, and the side walls 16 are pulled over the frame 18. An air conditioning or heating unit 20 may be installed after the walls 12, 16 and the roof 14 are secured in their desired locations. The manner in which the frame 18 is constructed, the walls 12, 16 and the roof 14 (collectively, the flexible cover for the shelter 10) are pulled into place over the frame 18, and connected to the frame 18, and the air conditioning/heating unit 20 is installed, may be as described in U.S. patent application Ser. No. 13/283,772, filed Oct. 28, 2011, and/or U.S. Provisional Patent Application No. 61/598,194, filed Feb. 13, 2012.

The entire disclosures of application Ser. No. 13/283,772 and 61/598,194 are incorporated herein by reference. The present invention should not be limited, however, to the configurations illustrated in application Ser. No. 13/283,772 and 61/598,194.

Figure 2:
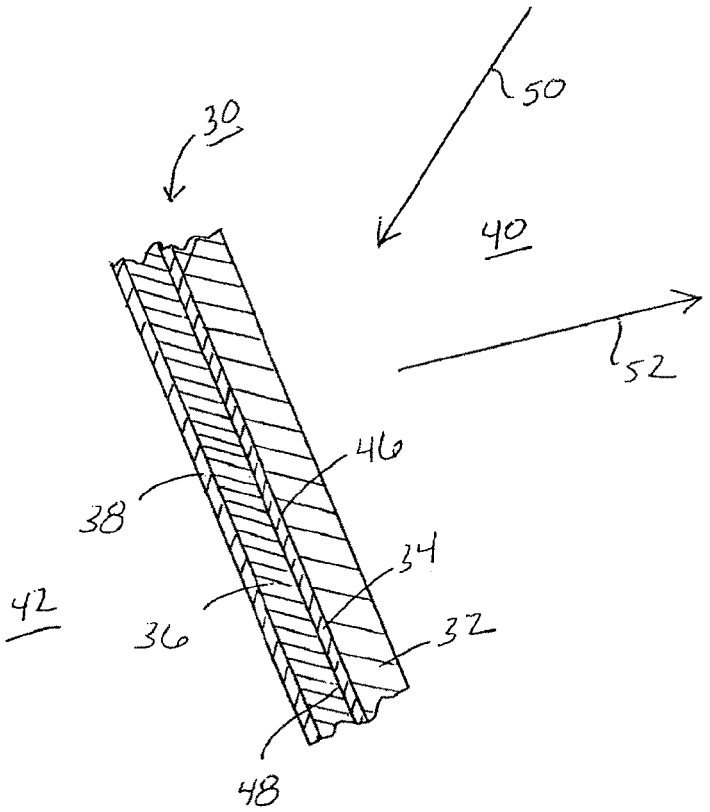
FIG. 2 is a partial cross-sectional view of the cover of FIG. 1, taken along line II-II of FIG. 1.

According to one aspect of the invention, the flexible cover 12, 14, 16 may be formed entirely of the multi-layer flexible fabric 30 that is illustrated in FIG. 2. The fabric 30 includes an outer layer 32, a metallized inner layer 34, an insulation layer 36, and a liner layer 38. When the shelter 10 is fully constructed, the outer layer 32 faces the outside 40, whereas the liner layer 38 faces the air-conditioned or heated interior 42 of the shelter 10.

The outer layer 32 may be formed of a flexible material that is tough, durable, rugged, and weather-resistant. The preferred material (32) is water-proof, mildew-resistant, ozone-resistant, and resistant to degradation that could otherwise be caused by high temperature, changes in temperature, rough handling, and sunlight, including ultraviolet light. In a preferred embodiment of the invention, the outer layer 32 includes a vinyl material, preferably a material formed of a synthetic polyvinyl chloride resin. If desired, the outer layer 32 may be formed of flexible, vinyl-coated polyester fabric. If desired, one or more outer vinyl layers 32 may be coated on the metallized layer 34 (or coated on another layer of the cover). In an alternative embodiment, one or more outer vinyl layers 32 may be laminated onto the metallized layer 34 (or laminated onto another layer of the cover).

In a preferred embodiment, the outer layer 32 can be used to conceal the metallized layer 34, and thereby help to conceal the shelter 10, for example, from optical detection (camouflage) and/or from detection by radar.

The metallized inner layer 34 may be formed of a material that reflects thermal radiation. The material (34) may be, for example, a metallic coating applied to the inside surface 46 of the outer layer 32. The metallic coating (34) may be formed of aluminum and/or an alloy of aluminum and silver. The coating (34) may be painted on the surface 46 of the outer layer 32. Alternatively, the coating (34) may be chemically deposited or vapor-deposited onto the inside surface 46 of the outer layer 32. If desired or required to prevent corrosion of the metallic layer 34, the inner surface 48 of the coating (34) may be treated or provided with a protective resin coating (not shown).

In operation, the inner layer 34 reflects incident thermal radiation 50 that is transmitted onto and through the outer layer 32. The reflective layer 34 causes the thermal radiation 52 to be re-transmitted back out through the outer layer 32, away from the shelter. Thus, the outer layer 32 and the metallized inner layer 34 cause the shelter to have low emissivity. Emissivity ($\varepsilon$) is inversely related to reflectivity and is the value given to a material based on the ratio of heat emitted compared to a blackbody, on a scale of 0 to 1, where a blackbody has an emissivity of 1 and a perfect reflector has an emissivity of 0. The shelter 10 shown in FIG. 1 may have an emissivity $\varepsilon$ that is less than or equal to 0.5 ($\varepsilon \leq 0.5$).

The insulation layer 36 (FIG. 2) may include one or more layers of a felt material, foam, or other multi-cellular heat-insulating material. The insulation material 36 may include air cells, pockets and tortuous paths for preventing conductive and convective heat transfer through the flexible material 30.

The liner layer 38 may be attached to the insulation layer 36. The liner layer 38 may be chemically adhered to the insulation layer 36, or the liner layer 38 may be attached to the insulation layer 38 by quilting or the like (not shown). Alternatively, the liner layer 38 may be separate from (not attached to) the insulation layer 36.

The illustrated shelter 10 (FIG. 1) may be, for example, an emergency medical tent that is on the order of thirty-two feet long, with an installed rigid floor (not shown). The shelter 10 has improved portability (it is easy to transport and quick to set up), and the shelter 10 may be less expensive to produce and deploy than known shelters. The invention is not limited to the shelter shown in the drawings. Among other things, the invention also relates to a tent, a semi-permanent home, and the like.

In an alternative embodiment, the air conditioning unit 20 may be replaced or supplemented by a heating unit that supplies heated air, or a unit for providing ventilation, or a unit that provides heat, ventilation, and/or air conditioning (cool air) (HVAC). The illustrated portable shelter may be deployed in a wide variety of climates and locations, including cold or very cold locations, where the cover described herein provides suitable insulation for efficiently retaining heat within the portable shelter.

The invention is not limited to the structures, methods and instrumentalities described above and shown in the drawings. The invention is defined by the claims set forth below.

What is claimed and desired to be protected by Letters Patent of the United States is:

1. A portable shelter for sheltering materials or human occupants at a remote location, said shelter comprising:
- a flexible, multi-layer cover; and
- a frame for supporting the flexible cover; and
- wherein the flexible cover includes a liner material, a thermal insulation material, a vinyl material and a reflective material, and wherein the reflective material is located inside the vinyl material for reflecting thermal radiation,
- wherein the vinyl material is located in an outermost layer of the flexible cover,
- wherein the reflective material is located adjacent to the outermost layer of the flexible cover,
- wherein the thermal insulation material is located inside the reflective material, such that the reflective material is located between the vinyl material and the thermal insulation material, and the thermal insulation material includes insulating material selected from the group consisting of felt material, foam, and other multi-cellular material,
- wherein the liner material includes a non-reflective material, the non-reflective material of the liner material contacts the insulating material of the thermal insulation material, such that the insulating material of the thermal insulation material is located between (1) the reflective material and (2) the non-reflective material of the liner material, and
- wherein the reflective material includes metal.

2. The portable shelter of claim 1, wherein the vinyl material is configured to weatherproof the shelter.

3. The portable shelter of claim 2, wherein the vinyl material includes vinyl-coated or -laminated polyester fabric.

4. The portable shelter of claim 1, wherein the metal includes aluminum.

5. The portable shelter of claim 1, wherein an emissivity ($\varepsilon$) of the shelter is less than or equal to 0.5.

6. The portable shelter of claim 1, wherein the reflective material is coated or deposited on the outermost layer of the flexible cover.

7. The portable shelter of claim 1, wherein the thermal insulation material inhibits convective and/or conductive transfer of thermal energy through the flexible cover.

8. The portable shelter of claim 1, further comprising an air conditioning unit for cooling or heating air and equipment located within the shelter.

9. A method of sheltering materials or human occupants at a remote location, said method comprising the steps of:
- transporting a shelter to the remote location, wherein the shelter includes a flexible, multi-layer cover, a frame for supporting the flexible cover, and a heating, ventilating and/or air conditioning (HVAC) unit, and wherein the cover includes a liner material, a thermal insulation material, a vinyl material and a reflective material,
  - wherein the vinyl material is located in an outermost layer of the flexible cover,
  - wherein the reflective material is located adjacent to the outermost layer of the flexible cover, wherein the thermal insulation material is located inside the reflective material, such that the reflective material is located between the vinyl material and the thermal insulation material, and the thermal insulation material includes insulating material selected from the group consisting of felt material, foam, and other multi-cellular material, wherein the liner material includes a non-reflective material, the non-reflective material of the liner material contacts the insulating material of the thermal insulation material, such that the insulating material of the thermal insulation material is located between (1) the reflective material and (2) the non-reflective material of the liner material;

transporting a power source for the HVAC unit, or fuel for the power source, to the remote location; and connecting the power source to the HVAC unit.

10. The method of claim 9, further comprising a step of constructing the shelter at the remote location.

11. The method of claim 9, wherein the vinyl material is water proof.

12. The method of claim 11, wherein the reflective material includes metal.

13. The method of claim 11, wherein an emissivity (ε) of the shelter is less than or equal to 0.5.

14. The method of claim 11, wherein the remote location is located more than one mile from any road or airport.

* * * * *